US005341742A

United States Patent [19]

Alford et al.

[11] Patent Number: 5,341,742

[45] Date of Patent: Aug. 30, 1994

[54] FIRING ARRANGEMENTS

[75] Inventors: Sidney Alford, Corsham; Graham M. Cook, West, both of United Kingdom

[73] Assignee: EEV Limited, Essex, United Kingdom

[21] Appl. No.: 960,502

[22] PCT Filed: Dec. 16, 1991

[86] PCT No.: PCT/GB91/02247

§ 371 Date: Oct. 13, 1992

§ 102(e) Date: Oct. 13, 1992

[87] PCT Pub. No.: WO92/10718

PCT Pub. Date: Jun. 25, 1992

[30] Foreign Application Priority Data

Dec. 14, 1990 [GB] United Kingdom ..... 9027203.0

[51] Int. Cl.[5] ..... F23Q 21/00

[52] U.S. Cl. ..... 102/202.8; 102/218

[58] Field of Search ..... 102/200, 202.3, 202.5, 102/202.8, 202.9, 202.14, 206, 218, 219, 229, 275.11, 275.12, 293; 361/251

[56] References Cited

U.S. PATENT DOCUMENTS

| | | | |
|---|---|---|---|
| 3,118,375 | 1/1964 | Jasse | 102/202.8 |
| 3,717,794 | 2/1973 | Yates et al. | 361/251 |
| 3,955,505 | 5/1976 | Johnston | 102/206 |
| 4,089,035 | 5/1978 | Smith | 102/218 |
| 4,092,927 | 6/1978 | Rayle | 102/229 |
| 4,239,004 | 12/1980 | Day et al. | 102/202.13 |
| 4,700,629 | 10/1987 | Benson et al. | 102/201 |
| 4,730,558 | 3/1988 | Florin et al. | 102/202.7 |
| 4,762,067 | 8/1988 | Barker et al. | 102/202.7 |
| 4,777,878 | 10/1988 | Johnson et al. | 102/202.5 |
| 4,884,507 | 12/1989 | Levy | 102/293 |
| 4,886,126 | 12/1989 | Yates, Jr. | 175/4.54 |
| 4,962,708 | 10/1990 | Snyder et al. | 102/275.6 |

FOREIGN PATENT DOCUMENTS

| | | |
|---|---|---|
| 051572 | 5/1982 | European Pat. Off. . |
| 279796 | 8/1988 | European Pat. Off. . |
| 314898 | 5/1989 | European Pat. Off. . |
| 3842917 | 11/1989 | Fed. Rep. of Germany . |
| 1047270 | 11/1966 | United Kingdom . |
| 1079583 | 8/1967 | United Kingdom . |
| 1105663 | 3/1968 | United Kingdom . |
| 1159975 | 7/1969 | United Kingdom . |
| 1163275 | 9/1969 | United Kingdom . |
| 1238503 | 7/1971 | United Kingdom . |
| 2213322 | 8/1989 | United Kingdom . |

*Primary Examiner*—Daniel T. Pihulic

*Attorney, Agent, or Firm*—Spencer, Frank & Schneider

[57] ABSTRACT

A firing arrangement for initiating a secondary explosive includes a switch, a charge storage circuit for storing an electrical charge, a power supply for charging the charge storage circuit, an initiator electrically connected to the charge storage circuit through the switch, for directly initiating the secondary explosive, and a common unit. The common unit is hand held during initiation and houses the initiator and at least one of the switch, the charge storage circuit, and the power supply. The common unit includes a manual activator for causing discharge of the charge storage circuit through the switch and initiator, to directly initiate the secondary explosive.

21 Claims, 3 Drawing Sheets

FIRING ARRANGEMENTS

BACKGROUND OF THE INVENTION

1. Field of the Invention

This invention relates to firing arrangements for initiating explosions.

2. Background Information

In conventional commercial demolition equipment, a detonator is used which contains a relatively sensitive primary explosive which is used to detonate a main charge of secondary explosive. When setting up a charge, or a series of charges interconnected by detonating cord, for demolition, it is usual practice to connect the detonator only after all the other components of the arrangement are in place. Thus, the detonation is thereby made possible only at the last moment and the risk of accidents reduced. Alternatively, where a series of charges is used, each is initiated by a separate detonator. Immediately the first charge is connected to its detonator, the remaining ones are made more sensitive to initiation. The use of detonators containing primary explosive means that connected charges are inevitably made sensitive, to the extent that stray electric currents caused by short circuits, or induced by adjacent electrical appliances or wiring, radio transmission or electrical storms, could bring about premature detonation. Also, the detonators, which are of a different hazard class from the main explosive charges, must be stored, transported and carried separately from the main charges, which is inconvenient.

An explosive is classed as a primary or secondary explosive depending on its sensitivity to initiation by temperature, percussion or friction. Primary explosives are highly sensitive and are such that a deflagration-detonation transformation (ddt) takes place when they are present in very small quantities, typically, a few milligrams with minimal confinement. Most primary explosives explode immediately on contact with a flame or spark. If they are capable of burning, then, once ignited, the speed of burning tends to increase rapidly to violent explosion with little confinement. Primary explosives are usually sensitive to detonation as a result of light friction or percussion, exposure to intense electromagnetic radiation (eg. a laser beam), or reaction with disruptive chemicals. Such explosives, which are subject to accidental explosion if carelessly treated, are thus too sensitive to be employed as bulk charges for such applications as blasting, or filling ammunition. Examples of primary explosives are lead and silver azides, and lead trinitroresorcinate, which are employed in detonators and percussion caps.

Secondary explosives are less sensitive than primary explosives and are sufficiently difficult to initiate that the probability of accidental initiation is low enough for them to be used as bulk charges, for example, in blasting and demolition cartridges, bombs and shells. Some examples of secondary explosive are TNT, ammonium nitrate/fuel mixtures, RDX and PETN.

SUMMARY OF THE INVENTION

The present invention seeks to provide a firing arrangement which is relatively cheap and convenient to use and has a number of advantages over conventional equipment.

According to the invention there is provided a firing arrangement for initiating a secondary explosive comprising a switch, charge storage means and power supply means for charging the storage means, the arrangement being arranged such that, on command, the charge storage means discharges via the switch and an initiator to directly initiate a secondary explosive, at least two components of the arrangement being included in a common unit suitable for hand held use during initiation.

By using an arrangement in accordance with the invention, circuitry may be employed which is less complex than previous equipment and which utilizes electronic components which are already commercially available so that the arrangement may be relatively inexpensive. Furthermore, the arrangement may be made much more compact and therefore easier to handle than conventional arrangements.

By excluding a conventional detonator requiring primary explosive, an arrangement in accordance with the invention is particularly safe in use, as accidental actuation is almost impossible. The very high intrinsic safety of an arrangement in accordance with the invention means that explosive charges may be set up, ready to fire with the means of initiation in place and left almost indefinitely with no risk of accidental firing.

The inclusion of at least two components of the arrangement in a common unit which is suitable for hand-held use results in apparatus which is particularly convenient to use and enables the advantages of the absence of primary explosive to be fully realized. Various combinations of the components may be housed in the common unit, one particularly advantageous embodiment incorporating the charge storage means, the switch, the initiator where this is distinct from the switch and power supply means within a single unit which may be small enough to fit in a pocket.

In a preferred embodiment of the invention, the arrangement is such that the initiator is removably fixed so that it may be readily replaced when necessary. It is envisaged that the life-time of the initiator will be less than that of the remainder of the components of the arrangement. By ensuring that the initiator may be easily changed when necessary without replacing the other components, costs may be reduced. Advantageously means are included for fixing alternative types of initiator in the common unit. The user may then choose the most suitable type for a particular use.

It is believed that firing arrangements in accordance with the invention may be particularly advantageously used for underwater applications.

One of the inconveniences of working underwater is the interfering influence of the surrounding water, including the greatly reduced visibility frequently encountered, and the time limit for which a diver may safely stay at given depth. The other great inconvenience is the time and expense of diving to the necessary depth and, even more so, the more protracted time necessary for decompression during the ascent.

A very important aspect of underwater work is therefore to accomplish a given task with as few dives as possible. To some extent the number of dives required for a given operation may be reduced by sending down equipment on ropes as a diver is ready for it but, in many underwater salvage operations, such as those within a wreck, the sending down of primed explosive charges is considered undesirable. It is therefore usual practice for the main charges to be set first, a separate dive being made to attach the detonator. The detonator then has to be attached quickly, but reliably to the main charges. This connection is frequently not made satisfactorily underwater.

A great advantage in using an arrangement in accordance with the invention is that the diver can not only carry it at the same time as the main charges, but that there is no reason why connection between the two should not be made on the surface whenever this is more convenient.

It has been found that, not only does the presence of water not inhibit initiation, but that it may even enhance the initiating power by acting as a shock-transmitting medium. Using an arrangement in accordance with the invention, it is possible to initiate a water-wet explosive not normally initiated by a standard detonator in that condition.

The initiator acts to receive an electrical pulse from the charge storage means and transform it into a form suitable for producing detonation of the secondary explosive. In some embodiments of the invention, the switch also acts as the initiator, giving simplified circuitry and reducing costs.

In one advantageous embodiment of the invention, the initiator is a spark gap device, a spark produced between electrodes of the device being arranged to initiate an explosion. The spark gap device may be of the over voltage type or could be a triggered spark gap. The latter is particularly advantageous as it enables precise timing of the discharge of the charge storage means, and hence initiation of the explosive, to be achieved. This is important where a series of charges are to be set off, either sequentially or simultaneously.

It may be preferred that the initiator be a spark gap device having electrodes which are arranged to produce a spark within a hollow shock tube lined with a thin layer of secondary explosive material, such as HMX, mixed with aluminum. The spark can be made sufficiently energetic to initiate the secondary explosive, producing a longitudinal shock wave which travels along the shock tube to a larger charge of secondary explosive remote from the initiator. Common types of shock tube which can be used are those known as "Nonel" (trade mark) and X-L.

In another arrangement, the initiator is a spark gap device in which the electrodes of the device are arranged to produce a spark at the end of a length of detonating cord, some of the explosive filling having been removed from the cord where the electrodes are inserted. In an alternative arrangement, the electrodes are in the form of pins inserted into the explosive contained within detonating cord. In addition to defining the spark gap, the pins may also be used to secure the detonating cord in position.

Another type of initiator uses an exploding bridge wire, which in one form consists of a thin, etched metal layer deposited on a plastic film or foil. When the electrical pulses is discharged from the charge storage means, it causes the bridge wire to become vaporized, propelling a fragment of the plastic film through an air gap towards the secondary explosive contained within the detonating cord. The impact of the foil upon the explosive causes the explosive to be initiated. In another arrangement of the invention, the exploding foil is arranged to be in direct contact with the secondary explosive, initiation occurring due to the shock wave generated by the explosive vaporization of the metal bridge.

In one advantageous embodiment of the invention, detonating cord is inserted within a cylindrical holder, at one end of which a metal strip, plastic foil bridge is located such that the secondary explosive filling the detonating cord abuts the plastic foil. Discharge of the charge storage means through the bridge initiates the explosive of the detonating cord.

Other types of initiator may also be used. For example, a thin conductive track may be supported by a ceramic blade, the track including a portion of reduced width which acts as a bridge wire. The ceramic blade enables the bridge wire to be accurately positioned with respect to the secondary explosive. This type of initiator is suitable for use with detonating cord. In another arrangement the initiator comprises two metal plates having a small contact area which in effect acts as a bridge wire. The blades may be co-planar or could be arranged orthogonally to one another.

BRIEF DESCRIPTION OF THE DRAWINGS

Some ways in which the invention may be performed are now described by way of example with reference to the accompanying drawings in which.

FIGS. *7a* and *7b* illustrate part of another arrangement in accordance with the invention.

DETAILED DESCRIPTION OF THE PREFERRED EMBODIMENT(S)

Figure 1:
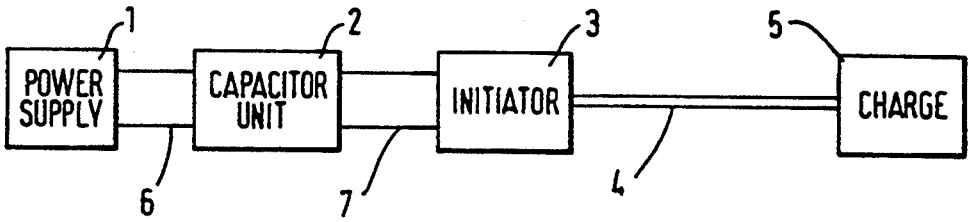
FIG. 1 shows a firing arrangement in accordance with the invention.
Figure 4:
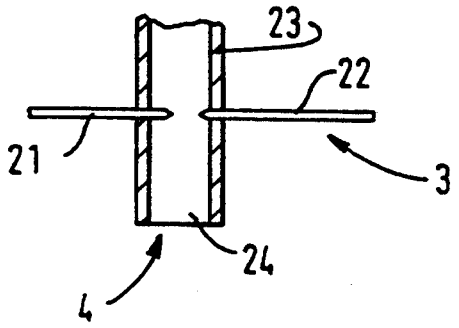

With reference to FIG. 1, a firing arrangement for initiating a charge of secondary explosive directly, without the need for a primary explosive, includes a power supply unit 1, a capacitor unit 2 and an initiator 3 which is connected to a detonating cord 4, comprising a plastic tube filled with secondary explosive. The detonating cord 4 is attached at its other end to the main explosive charge 5. The power supply unit 1, capacitor unit 2 and initiator 3 are connected via paired cables 6 and 7. The paired cable 6 is suitable for high voltage transmission and the cable 7 is of low impedance. In this embodiment of the invention, the initiator 3, as schematically illustrated in FIG. 4, is a spark gap having two electrodes in the form of pins 21 and 22 which are inserted through the plastic coating 23 of the detonating cord 4 in a region 24 where the explosive filling has been removed.

Figure 2:
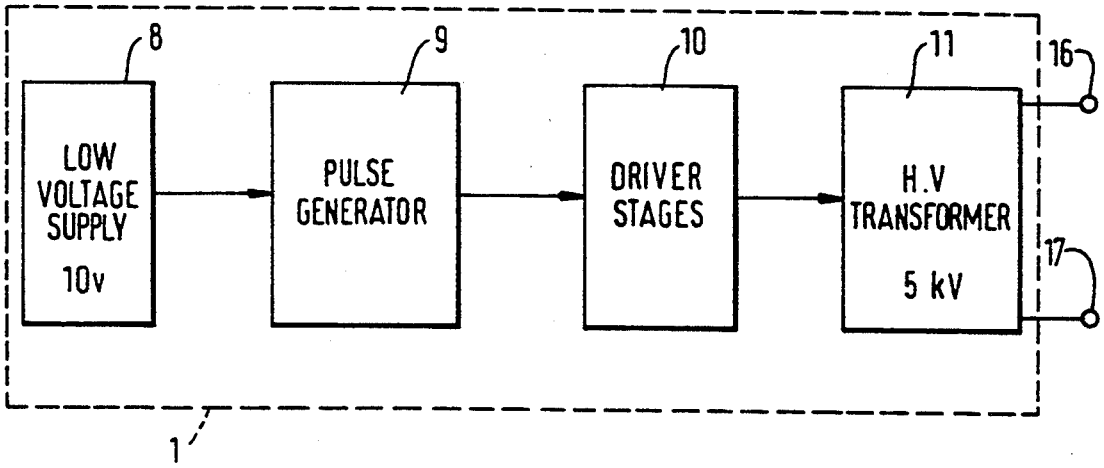
FIGS. 2, 3 and 4 schematically illustrate parts of the arrangement of FIG. 1 in greater detail.

The power supply unit 1 is illustrated in greater detail in FIG. 2 and is arranged to supply an output at 5 kV. It includes a low voltage power source 8 followed by a pulse generator 9 and driver stages 10. The output of the power supply unit 1 is derived via an HV transformer circuit 11 and applied to the capacitor unit 2.

Figure 3:
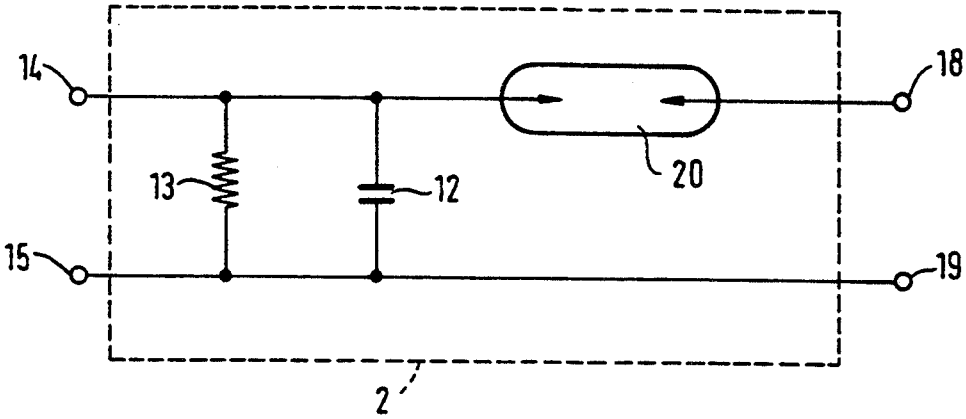

The capacitor unit 2 is shown in greater detail in FIG. 3 and comprises a low inductance capacitor 12 across which is connected a bleed resistor 13. The input terminals 14 and 15 of the capacitor unit 2 are connected via the paired cable 6 to the output terminals 16 and 17 of the power supply unit 1. The terminals of the capacitor 12 are connected to output terminals 18 and 19 of the capacitor unit 2 via a high speed switch, which in this embodiment of the invention is a spark gap 20.

Figure 5:
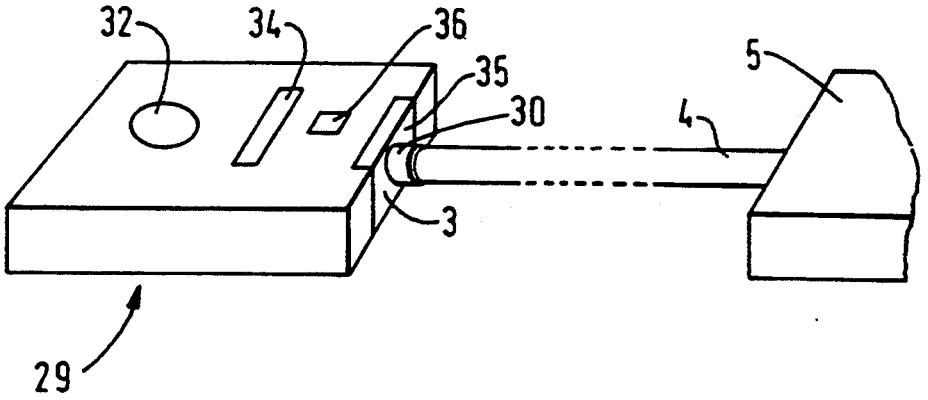
FIG. 5 schematically illustrates an embodiment of the invention.
Figure 7A:
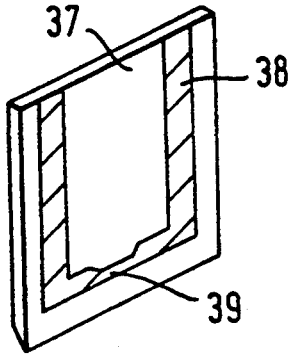
Figure 7B:
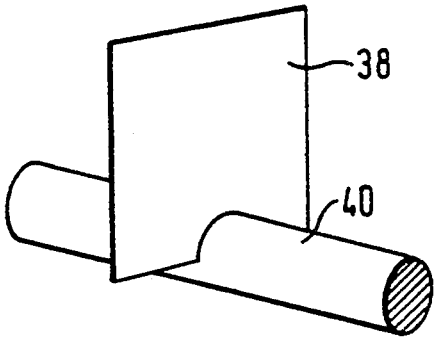

The component parts of the firing arrangement are combined within a single common unit 29 as illustrated in FIG. 5 which is compact enough to be easily held in the hand. The unit 29 houses the low voltage supply, the high voltage output, the capacitor, switch and initiator. The arrangement includes a port 30 into which the detonating cord 4 is inserted so that the electrode pins of the spark gap initiator 3 are pushed into the detonating cord. The unit 29 also includes a button 32 which an operator depresses when he wishes to initiate the explosive of the detonating cord 4, and hence the main charge.

When the button 32 is depressed, the power supply unit 1 is arranged to charge the capacitor 12. Before the full voltage of 5 kV is applied, the spark gap 20 breaks down, at about 4 kV, causing the capacitor 12 to discharge through the initiator 3.

The high current electrical pulse derived from the capacitor 12 causes an energetic spark to be produced between the electrodes 21 and 22 of the spark gap initiator 3, causing the detonating cord 4 to be initiated, which in turn initiates the main charge 50.

The bleed resistor 1B ensures that if for any reason the capacitor 12 does not discharge through the initiator 3, for example if the cable 7 becomes disconnected, the capacitor 12 discharges through the resistor 13 after a set time, ensuring that the arrangement is then safe to handle.

The hand-held common unit 29 includes a counter 34 which monitors each operation of the initiator 3. The initiator 3 is contained within a removable head 35 so that, after a given number of operations, the head 35 may be replaced. The unit further includes a lock 36 which can be used to prevent the unit 32 from operating, hence eliminating unauthorized use of the arrangement.

The hand-hand held unit 29 is able to accept different types of initiator head 35 so that a particular one may be used for a given application without requiring another unit. Thus, where it is wished to use a different spark gap initiator, such as illustrated schematically in FIG. 6 a different interchangeable initiator head is selected.

Figure 6:
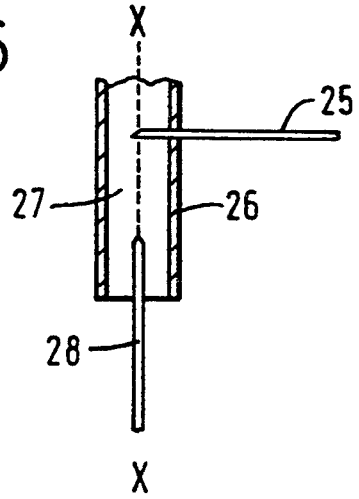
FIG. 6 schematically illustrates an embodiment of the invention.

In the type of initiator shown in FIG. 6, one electrode 25 is inserted through the plastic wall 26 of detonating cord 27 orthogonal to the longitudinal axis X of the cord. The other pin 28 is inserted axially into the cut end of the detonating cord 27. This enables the electrodes to be spaced further apart than the diameter of the detonating cord 27.

In another embodiment of the invention, the initiator is an exploding foil initiator in which the high current electrical pulse from the charge storage means is converted into a high energy density, mechanical shock wave. Again this type of initiator could be used with the hand-held unit shown in FIG. 5, although a separate dedicated unit may be employed instead.

FIGS. *7a* and *7b* schematically illustrate another type of initiator suitable for use with detonating cord. In this type, a ceramic blade 37 supports a conductive track 38 housing a portion 39 of reduced width near one edge. The ceramic blade 37 is pushed into the detonating cord 40 as schematically shown in FIG. *7b* and positioned such that the portion 39 is in contact with the explosive contained within the outer casing of the detonating cord 40. When a high energy electrical pulse is transmitted along the track 38, the portion 39 vaporizes and initiates the detonating cord.

Figure 8:
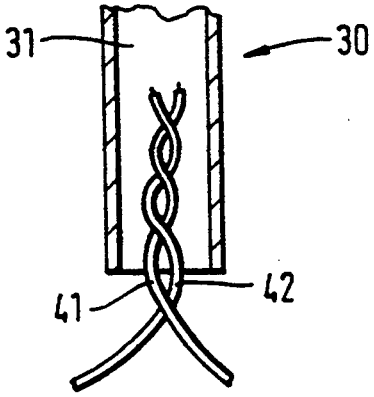
FIG. 8 shows part of the embodiment of FIG. 7 in greater detail.

The hand-held unit 29 may also be used to initiate a main charge using shock tube. One form of initiator suitable for use with shock tube is schematically shown in FIG. 8 and comprises two twisted, insulated wires 41 and 42 contained within the initiator head and over which the shock tube 31 is pushed. When the capacitor discharges, a spark is produced between the ends of the wires and detonates the shock tube 31 which is attached to the main charge.

In another form of the arrangement, only the charge storage means, power supply and switch are contained within a hand held unit. The initiator is separate and placed near the main charge. This type of arrangement requires that low inductance leads between the capacitor and the initiator at the explosive be used.

We claim:

1. A firing arrangement for initiating a secondary explosive comprising:

a switch, charge storage means electrically connected to said switch, for storing an electrical charge, power supply means electrically connected to said charge storage means, for charging said charge storage means, an initiator electrically connected to said charge storage means through said switch, for directly initiating the secondary explosive, and a common unit, which during initiation is hand held, for housing said initiator and at least one of said switch, said charge storage means, and said power supply means, and including manually activated means for causing discharge of said charge storage means through said switch and said initiator, to directly initiate the secondary explosive.

2. An arrangement as claimed in claim 1 wherein said common unit houses said charge storage means and said initiator.

3. An arrangement as claimed in claim 1 wherein said initiator is removably fixed in said common unit.

4. An arrangement as claimed in claim 3 further comprising fixing means for fixing alternative types of said initiator in said common unit.

5. An arrangement as claimed in claim 1 wherein said common unit houses said switch.

6. An arrangement as claimed in claim 1 wherein said switch and said initiator are a single device.

7. An arrangement as claimed in claim 1 further comprising a counter for accounting how many time said initiator is activated.

8. An arrangement as claimed in claim 1 wherein said charge storage means comprises a bleed resistor, and a capacitor having two terminals across which said bleed resistor is connected.

9. An arrangement as claimed in claim 1 wherein said switch comprises a spark gap device.

10. An arrangement as claimed in claim 1 wherein said initiator comprises a spark gap device.

11. An arrangement as claimed in claim 10 wherein said initiator comprises two twisted, insulated conductors having bare ends between which a spark is produced by the discharge of said charge storage means at activation of said initiator.

12. An arrangement as claimed in claim 1 wherein said initiator includes means for initiating the secondary explosive by producing a mechanical shock wave when an electrical pulse from said charge storage means is transmitted through said initiator.

13. An arrangement as claimed in claim 1 wherein said initiator includes means for causing a projectile to impinge on the secondary explosive when an electrical pulse from said charge storage means is transmitted through said initiator.

14. An arrangement as claimed in claim 1 wherein said initiator comprises a blade of electrically insulating material supporting a conductive track which has a region of reduced width.

15. An arrangement as claimed in claim 1 further comprising an elongate housing, wherein the secondary explosive is included in said elongate housing.

16. An arrangement as claimed in claim 15 further comprising a detonating cord, wherein the secondary explosive is included in said detonating cord.

17. An arrangement as claimed in claim 15 further comprising a shock tube, wherein the secondary explosive is included in said shock tube.

18. An arrangement as claimed in claim 15, wherein said elongate housing is connected to said initiator at one end and to the secondary explosive at another end.

19. An arrangement as claimed in claim 15 wherein said initiator comprises a spark gap device having electrodes, said electrodes being inserted into said elongate housing.

20. An arrangement as claimed in claim 19 wherein said electrodes of said spark gap device are disposed in said elongate housing so that a discharge is produced between two of said electrodes of said spark gap device in a substantially axial direction along said elongate housing.

21. An arrangement as claimed in claim 1 wherein said power supply means is connected across said charge storage means and is disposed in said common unit.

* * * * *